US007963719B2

(12) United States Patent
Wilson, Sr.

(10) Patent No.: US 7,963,719 B2
(45) Date of Patent: Jun. 21, 2011

(54) APPARATUS AND METHOD FOR APPLYING COATINGS TO A SURFACE

(76) Inventor: Jack H. Wilson, Sr., Ridgeland, MS (US)

( * ) Notice: Subject to any disclaimer, the term of this patent is extended or adjusted under 35 U.S.C. 154(b) by 771 days.

(21) Appl. No.: 11/790,505

(22) Filed: Apr. 26, 2007

(65) Prior Publication Data

US 2008/0268144 A1 Oct. 30, 2008

(51) Int. Cl.
*B05B 11/00* (2006.01)

(52) U.S. Cl. ..... 404/93; 404/108; 239/154

(58) Field of Classification Search ..... 404/107, 404/108, 110, 111, 93, 94; 222/129; 239/152, 239/154

See application file for complete search history.

(56) References Cited

U.S. PATENT DOCUMENTS

| | | | | | |
|---|---|---|---|---|---|
| 1,513,382 | A | * | 10/1924 | Fischer | 264/31 |
| 1,613,736 | A | * | 1/1927 | Andresen | 404/95 |
| 1,750,104 | A | * | 3/1930 | Heltzel | 404/107 |
| 1,912,897 | A | * | 6/1933 | Huet | 404/92 |
| 2,197,878 | A | * | 4/1940 | Robinson | 404/110 |
| 3,519,169 | A | * | 7/1970 | Holland | 222/626 |
| 3,945,571 | A | * | 3/1976 | Rash | 239/152 |
| 4,124,325 | A | * | 11/1978 | Cutler | 404/75 |
| 4,511,284 | A | * | 4/1985 | Sterner | 404/111 |
| 4,732,109 | A | * | 3/1988 | Selby | 118/713 |
| 4,831,958 | A | * | 5/1989 | Selby | 118/108 |
| 4,856,931 | A | * | 8/1989 | Bollag | 404/75 |
| 4,863,104 | A | | 9/1989 | Masterson | |
| 5,069,392 | A | * | 12/1991 | Wise et al. | 239/675 |
| 5,069,578 | A | * | 12/1991 | Bense et al. | 404/75 |
| 5,096,125 | A | * | 3/1992 | Wise et al. | 239/675 |
| 5,419,654 | A | * | 5/1995 | Kleiger | 404/101 |
| 5,439,313 | A | * | 8/1995 | Blaha et al. | 404/75 |
| 5,478,015 | A | * | 12/1995 | Black | 239/154 |
| 5,544,972 | A | * | 8/1996 | Boldt | 404/75 |
| 5,895,173 | A | * | 4/1999 | O'Brien et al. | 404/108 |
| 5,897,914 | A | * | 4/1999 | DePriest | 427/137 |
| 6,173,904 | B1 | * | 1/2001 | Doherty et al. | 239/1 |
| 6,220,782 | B1 | * | 4/2001 | Yates | 404/75 |
| 7,033,106 | B2 | * | 4/2006 | Harvey | 404/107 |
| 7,104,724 | B2 | * | 9/2006 | Terry | 404/110 |

* cited by examiner

*Primary Examiner* — Gary S Hartmann

(74) *Attorney, Agent, or Firm* — Merek, Blackmon & Voorhees, LLC

(57) ABSTRACT

A method and apparatus for applying various different coating on surfaces including but not limited to roadways, parking lots, bridge decks, airport runways, offshore heliports and workboat walkways. Preferably, an applicator is provided that allows numerous different coatings to be applied to a surface. The coatings may be protective, decorative, non-skid and/or reflective in nature. Preferably, the applicator allows for the dispensing of two or more materials in at least two different manners (e.g., (i) two or more materials simultaneously applied to the surface to be coated; and, (ii) one material applied followed by application of one or more additional materials). Preferably, the applicator is lightweight and compact so that a single individual can carry the applicator while applying a coating to a surface to be coated. This allows the applicator to be used to coat surfaces in constricted areas including but not limited to workboat walkways. The applicator, in its preferred form, permits a non-skid coating to be applied in a single step with the aggregate being encapsulated by the binder or coating material to prolong the life of the non-skid surface.

20 Claims, 7 Drawing Sheets

APPARATUS AND METHOD FOR APPLYING COATINGS TO A SURFACE

FIELD OF THE INVENTION

The present invention is directed to an apparatus and method for applying coatings to various surfaces. The coatings can take many forms including but not limited to a protective coating, a decorative coating, a non-skid coating and a reflective coating. Similarly, the surface to be coated may take many forms including but not limited to offshore heliports, workboat walkways, airport runways, roadways, parking lots and bridge decks.

BACKGROUND OF THE INVENTION

Coatings have been applied to various different surfaces for various reasons. Concrete and asphalt surfaces have been treated with various coatings to protect these surfaces from the effects of environmental and other exposures (e.g., ultraviolet light, water, aggressive chemical spills, and abrasion). The protective coatings include epoxy type coatings as well as a polymer modified cementitious compounds. One well-known protective coating is E-KRETE® manufactured by Polycon of Madison, Miss. Other coatings are designed to be reflective in nature. For example, directional indicia including arrows are formed on roadways, parking lots and other areas to provide instructions to a vehicle operator and/or a pedestrian. These directional indicia include a reflective material (e.g. glass beads) so that the directional indicia can be readily seen. The reflective material is adhered to the road surface by a suitable binder. Other coatings are designed to form a non-skid surface on various structures including but not limited to offshore heliports, workboat walkways, airport runways, roadways, or bridge decks.

Depending on the coating to be applied as well as the structure or surface to be coated, the application process may vary significantly. For example, in the case of a reflective coating, it is essential that the reflective material be properly bound to a surface without completely covering the reflective material so that the reflective coating can properly function. The reflective coating is typically applied in at least two steps. The binder is initially applied to the surface to be coated and then the reflective material is broadcast over the binder to adhere the reflective material to the surface to be coated without completely covering the reflective material. In the case of non-skid surfaces, the aggregate must be embedded in the binder (e.g., epoxy or cementitious coating) so that the aggregate is not readily dislodged from the binder. Non-skid surfaces of the epoxy type have been applied in several steps. In the first step, the binder or wet material is rolled out on the desired surface. Subsequently, sand is broadcast by hand onto the wet material. The sand is then rolled into the binder or wet material to properly embed the sand to prevent it from being dislodged. Once the first coat of binder or wet material has dried, a second coat of the binder is sprayed over the first coat to encapsulate and lock-in the sand.

It is desirable to provide a single device that can apply different coatings in different environments without significant modification thereof. Further, it is desirable to provide a device that reduces the steps necessary to apply a particular coating to a surface. Moreover, it is desirable to provide a device that is compact in size, portable and operable by a single individual so that a coating can be readily applied to constricted areas including but not limited to workboat walkways. It is further desirable to provide a applicator that applies particular materials to a surface to be coated in a uniform and consistent manner.

OBJECTS AND SUMMARY OF THE INVENTION

An object of a preferred embodiment of the present invention is to provide a novel and unobvious method and/or apparatus for applying a coating to a surface.

Another object of a preferred embodiment of the present invention is to provide an apparatus that is designed to apply different coatings in different manners without significant modification to the apparatus.

A further object of a preferred embodiment of the present invention is to provide a single step method of applying a non-skid coating to a surface.

Yet still another object of a preferred embodiment of the present invention is to provide an apparatus that can simultaneously apply an aggregate and a binder to a surface to be coated such that the aggregate becomes embedded in the binder upon impact with the surface to be coated.

Still a further object of a preferred embodiment of the present invention is to provide an apparatus that can apply two or more materials to a surface to be coated in at least two different manners (e.g., (i) materials simultaneously applied to the surface to be coated; and, (ii) one material applied first followed by application of one or more additional materials).

Another object of a preferred embodiment of the present invention is to provide a compact coating applicator that can be readily carried by an operator to apply various coatings in constricted areas.

A further object of a preferred embodiment of the present invention is to provide a coating applicator that includes a pressurized fluid system for supplying a first pressurized fluid to dispense a first material and a second pressurized fluid to dispense a second material where the first pressurized fluid is at a lower pressure than the second pressurized fluid.

Still a further object of a preferred embodiment of the present invention is to provide a coating applicator that includes a pressurized fluid system for supplying a first pressurized fluid to dispense a first material and a second pressurized fluid to both dispense a second material and agitate the first material where the first pressurized fluid is at a higher pressure than the second pressurized fluid.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, one embodiment of the present invention is directed to an apparatus for applying a coating to a surface. The apparatus includes a hopper assembly having a first compartment and a second compartment operably associated with the first compartment. The first compartment is configured to receive and store an aggregate. The second compartment is configured to receive and store a coating substance. The hopper assembly is further configured such that the aggregate does not mix with the coating substance when the aggregate and the coating substance are stored in the first compartment and the second compartment, respectively. The apparatus further includes means for simultaneously dispensing the aggregate and the coating substance from the first compartment and the second compartment so that at least a portion of the aggregate stored in the first compartment mixes with the coating substance after the aggregate and the coating substance are dispensed from the first compartment and the second compartment, respectively.

Another embodiment of the present invention is directed to an apparatus for applying a coating to a surface. The apparatus includes a hopper assembly having a first compartment and a second compartment operably associated with the first compartment. The first compartment is configured to receive and store a first material. The second compartment is configured to receive and store a second material. The first material is different from the second material. A first applicator gun operably associated with the first compartment for dispensing the first material from the first compartment and onto a surface to be coated. A second applicator gun is operably associated with the second compartment for dispensing the second material from the second compartment and onto a surface to be coated. The apparatus further includes a support member for supporting the hopper assembly, the first applicator gun and the second applicator gun about an individual's body to allow the individual to carry the hopper assembly, the first applicator gun and the second applicator gun while material is being dispensed from the hopper assembly.

A further embodiment of the present invention is directed to an apparatus for applying a coating to a surface. The apparatus includes a hopper assembly having a first compartment and a second compartment operably associated with the first compartment. The first compartment is configured to receive and store a first material. The second compartment is configured to receive and store a second material. The first material has at least one property different from the second material. A first dispenser operably associated with the first compartment for dispensing the first material from the first compartment and onto a surface to be coated. A second dispenser operably associated with the second compartment for dispensing the second material from the second compartment and onto a surface to be coated. The second dispenser is disposed relative to the first dispenser such that the second material mixes with the first material upon contacting a surface to be coated.

Still another embodiment of the present invention is directed to a method for applying a coating to a surface. The method comprises the steps of: (a) providing a hopper assembly having a first compartment and a second compartment connected to the first compartment, the first compartment is configured to receive and store an aggregate, the second compartment is configured to receive and store a coating substance, the hopper assembly is further configured such that the aggregate does not mix with the coating substance when the aggregate and the coating substance are stored in the first compartment and the second compartment, respectively; (b) providing at least a first dispenser for dispensing the aggregate and the coating substance from the first compartment and said the compartment; and, (c) simultaneously dispensing the aggregate and the coating material from the hopper assembly such that the coating material encapsulates at least a portion of the aggregate.

Yet another embodiment of the present invention is directed to an apparatus for applying a coating to a surface. The apparatus comprises a hopper assembly having a first compartment and a second compartment operably associated with the first compartment. The first compartment is configured to receive and store a first material. The second compartment is configured to receive and store a second material. The first material is different from the second material. A first applicator gun is operably associated with the first compartment for dispensing the first material from the first compartment and onto a surface to be coated. A second applicator gun is operably associated with the second compartment for dispensing the second material from the second compartment and onto a surface to be coated. The apparatus further includes a pressurized air system for providing pressurized air to the first applicator gun and pressurized air to the second applicator gun wherein pressurized air directed to the first applicator gun is at a different air pressure than pressurized air directed to the second applicator gun.

Yet still a further embodiment of the present invention is directed to a method of applying a non-skid coating to a surface. The method comprises the steps of: (a) providing a hopper assembly having a first compartment and a second compartment connected to the first compartment, the first compartment is configured to receive and store an aggregate, the second compartment is configured to receive and store a coating substance, the hopper assembly further includes at least a first dispenser for dispensing the aggregate and the coating substance from the first compartment and the second compartment; and, (c) dispensing the aggregate from the first compartment; and, (d) during step (c) dispensing the coating substance from the second compartment.

A further embodiment of the present invention is directed to an apparatus for applying a coating to a surface including a hopper assembly having a first compartment and a second compartment operably associated with the first compartment. The first compartment is configured to receive and store a first material. The second compartment is configured to receive and store a second material. The hopper assembly is further configured such that the first material does not mix with the second material while the first material and the second material are stored in the first compartment and the second compartment, respectively. The apparatus further includes a dispenser system for dispensing the first material and the second material from the first compartment and the second compartment, respectively. The dispenser system is configured to simultaneously dispense the first material and the second material from the first compartment and said second compartment. The dispenser system further is configured to dispense one of the first material and the second material from a corresponding compartment without dispensing the other of the first material and the second material from a corresponding compartment.

DETAILED DESCRIPTION OF THE PREFERRED EMBODIMENT OF THE INVENTION

The most preferred form of the invention will now be described with reference to FIGS. 1-7. The appended claims are not limited to the most preferred form and no term used herein is to be given a meaning other than its ordinary meaning unless otherwise stated.

FIGS. 1 through 7

Figure 1:
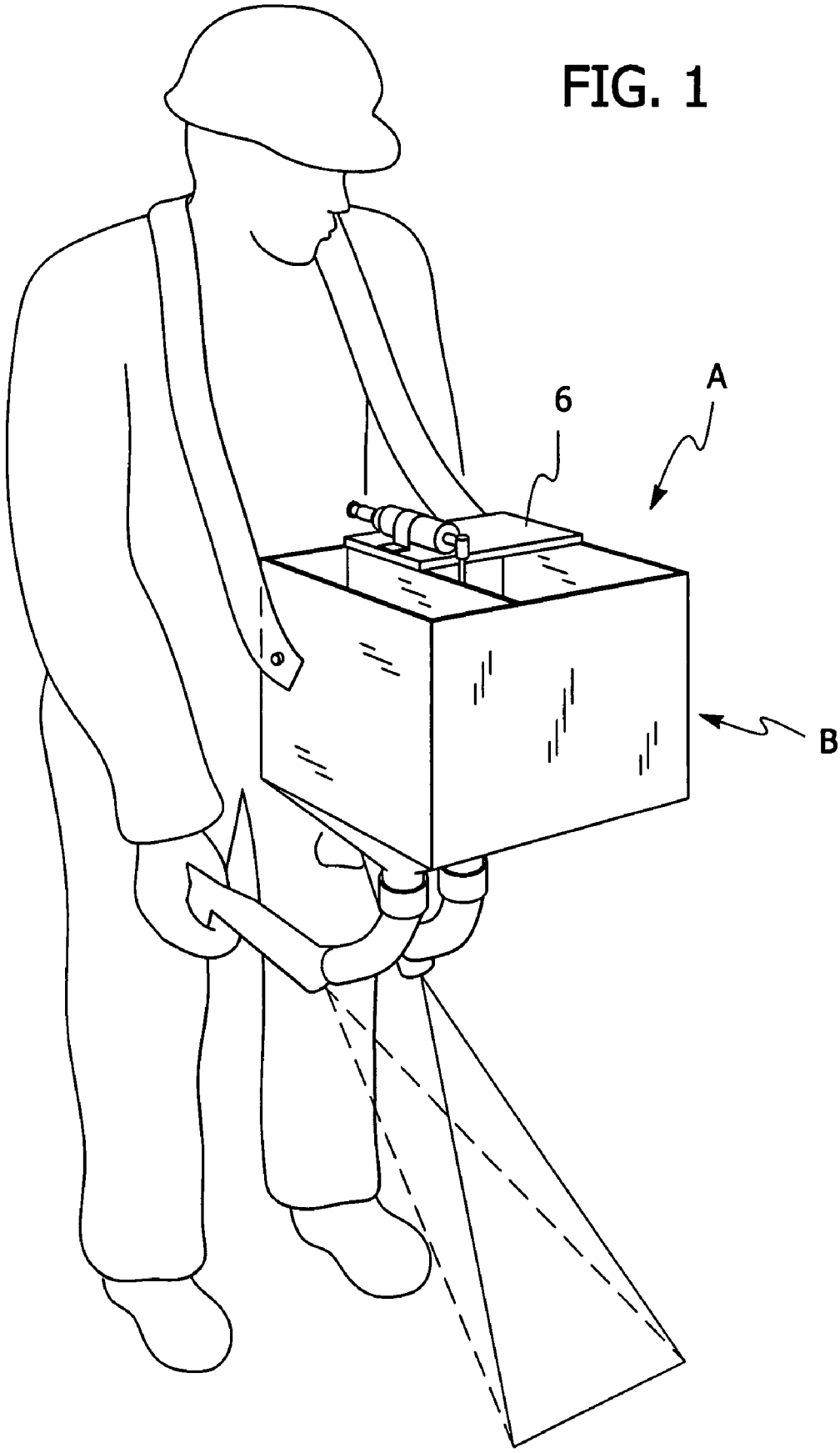
FIG. 1 is a perspective view of an individual using an applicator/dispenser formed in accordance with a preferred embodiment of the present invention to coat a surface.

Referring to FIGS. 1 to 7, a preferred form on applicator A is illustrated. As is clearly depicted in FIG. 1, applicator A is lightweight and compact so that a single individual can carry applicator A while dispensing materials therefrom. A harness 1 may be connected to hopper assembly B to support the applicator about the shoulders of an individual. FIG. 1 also illustrates one manner of applying a coating with applicator A. More specifically, FIG. 1 illustrates how applicator A is used to apply a non-skid coating to a surface. The binding or coating material (e.g., cementitious material, epoxy, etc.) and aggregate (e.g., sand, walnut shells, etc.) is dispensed from hopper assembly B simultaneously such that the aggregate is encapsulated by the coating material upon impacting the surface to be coated. The stream of binding material is represented by solid lines while the stream of aggregate is represented by dashed lines in FIG. 1. The precise manner of achieving encapsulation will be explained in detail below.

Referring to FIGS. 1 to 6, hopper assembly B preferably includes at least two compartments 2 and 4 isolated by an internal wall 3, i.e., materials in compartments 2 and 4 are not permitted to mix in the hopper. While two compartments are illustrated, it will be readily understood that the number of compartments may be varied as desired. When applying a non-skid coating to a surface, compartment 2 will contain a binding or coating material (e.g., cementitious material, epoxy, etc.), while compartment 4 will contain an aggregate (e.g., sand, walnut shells, etc.). Preferably, compartments 2 and 4 are sized such that when filled there is a sufficient amount of aggregate for the corresponding amount of binding or coating material to achieve a non-skid coating of a uniform consistency over the coated surface area. A plate 6 is mounted about the upper portion of the hopper B. It should be noted that plate 6 only covers a portion of one (see for example FIG. 1) or both (see for example FIG. 2) compartments 2 and 4 thereby allowing compartments 2 and 4 to be readily filled with the appropriate material when necessary. A mixing assembly C is mounted on plate 6 by a bracket 8. It will be readily appreciated that any suitable fastening arrangement may be used to secure mixing assembly C to hopper B.

Mixing assembly C preferably includes a pneumatic motor 10 and an agitator 12 operably connected thereto. In the embodiment depicted in FIGS. 1 to 7, the agitator is rotated by motor 10 to maintain the desired consistency of the binding or coating material. However, the present invention is not limited to a pneumatic motor or a rotating agitator rather any suitable means may be used to maintain the consistency of the materials in compartment 2.

Pneumatic spray guns 14 and 16 are connected to compartments 2 and 4, respectively by rubber hoses 18 and 20. Rubber hose 18 is removably connected at one end to outlet 22 of compartment 2 and removably connected at the other end to feeding chamber 24 (shown in FIG. 7) of gun 14 by any suitable fasteners including but not limited to adjustable clamps commonly used to connect rubber hoses to other structures. Similarly, Rubber hose 20 is removably connected at one end to outlet 26 of compartment 4 and removably connected at the other end to feeding gun 16 by any suitable fasteners including but not limited to adjustable clamps commonly used to connect rubber hoses to another structure. This arrangement allows the hoses 18 and 20, guns 14 and 16 and hopper B to be readily separated for cleaning and/or storage.

Figure 7:
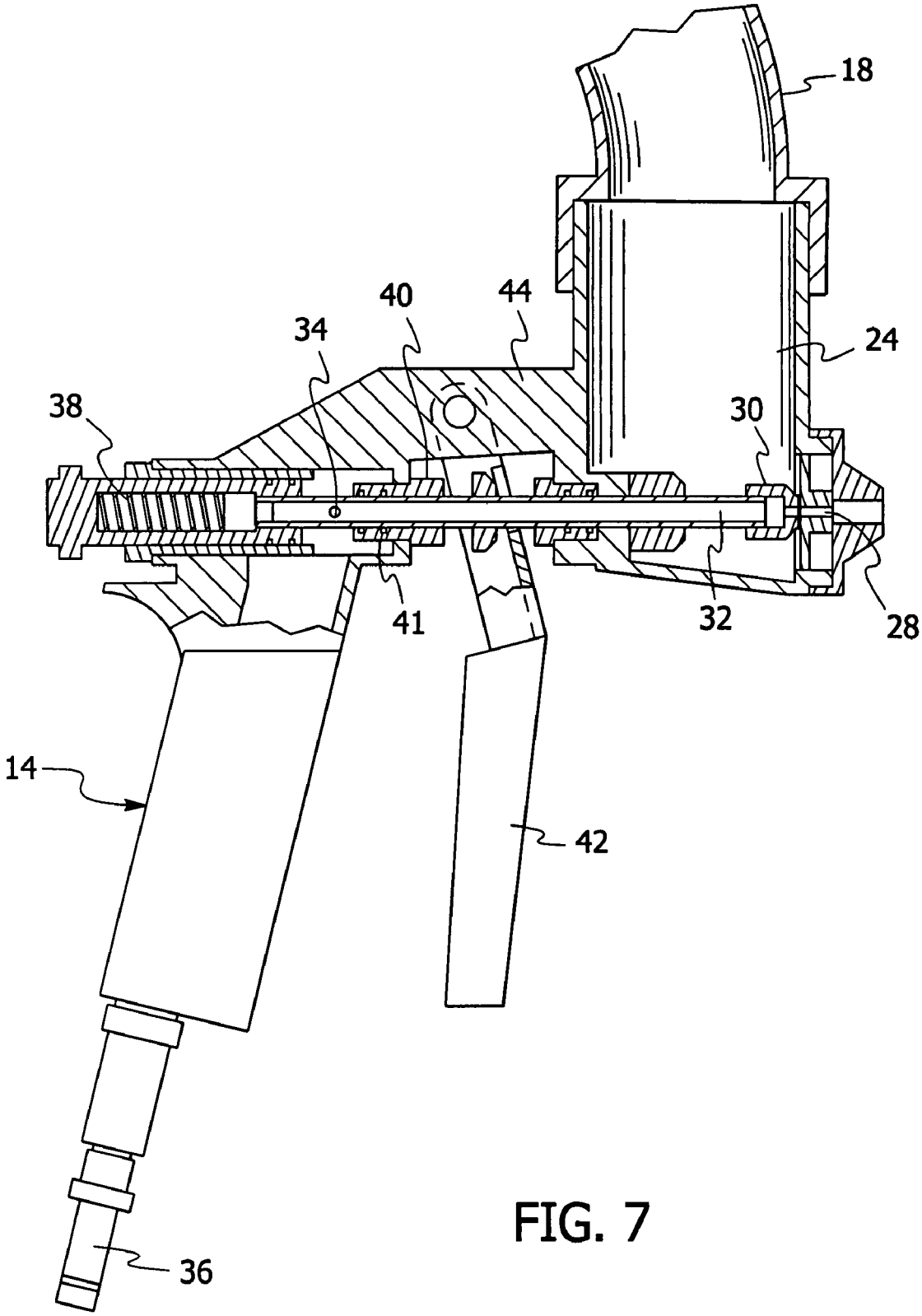
FIG. 7 is a fragmentary cross-sectional view of a portion the applicator/dispenser formed in accordance with a preferred embodiment of the present invention.

The inner workings of guns 14 and 16 are the same and, therefore, only one will be described in detail. Referring to FIG. 7, gun 14 includes a cylindrical feeding chamber 24 for receiving material stored in compartment 2 via hose 18. Preferably, the material is fed by gravity through hose 18 into chamber 24. As illustrated in FIG. 7, the material cannot be sprayed out of the gun due to the fact that outlet 28 is closed by sealing member 30. Sealing member 30 is mounted on hollow conduit 32. One or more openings 34 are formed in conduit 32 for directing a pressurized fluid (e.g., air) through conduit 32. A pressure source is connected to gun 14 at connector 36. Spring 38 biases conduit 32 to the right as shown in FIG. 7 so that sealing member 30 seals outlet 28. Collar 40 is fixed to conduit 32 such that collar 40 moves with conduit 32. Collar 40 can be biased to the right as seen in FIG. 7 by a spring 41. Gun 14 includes a trigger 42 pivotally mounted to body 44. When trigger 42 is pulled back, collar 40 moves to the left as seen in FIG. 7. This leftward movement of collar 40 causes the conduit 32 and sealing member 30 to move to the left as seen in FIG. 7 opening outlet 28. The material in feed chamber 24 is driven out through outlet 28 by the pressurized fluid passing through conduit 32. The inner workings of pneumatic spray guns are well know and one suitable structure is described in detail in U.S. Pat. No. 4,863,104, the entire contents of which is incorporated herein by reference.

Figure 2:
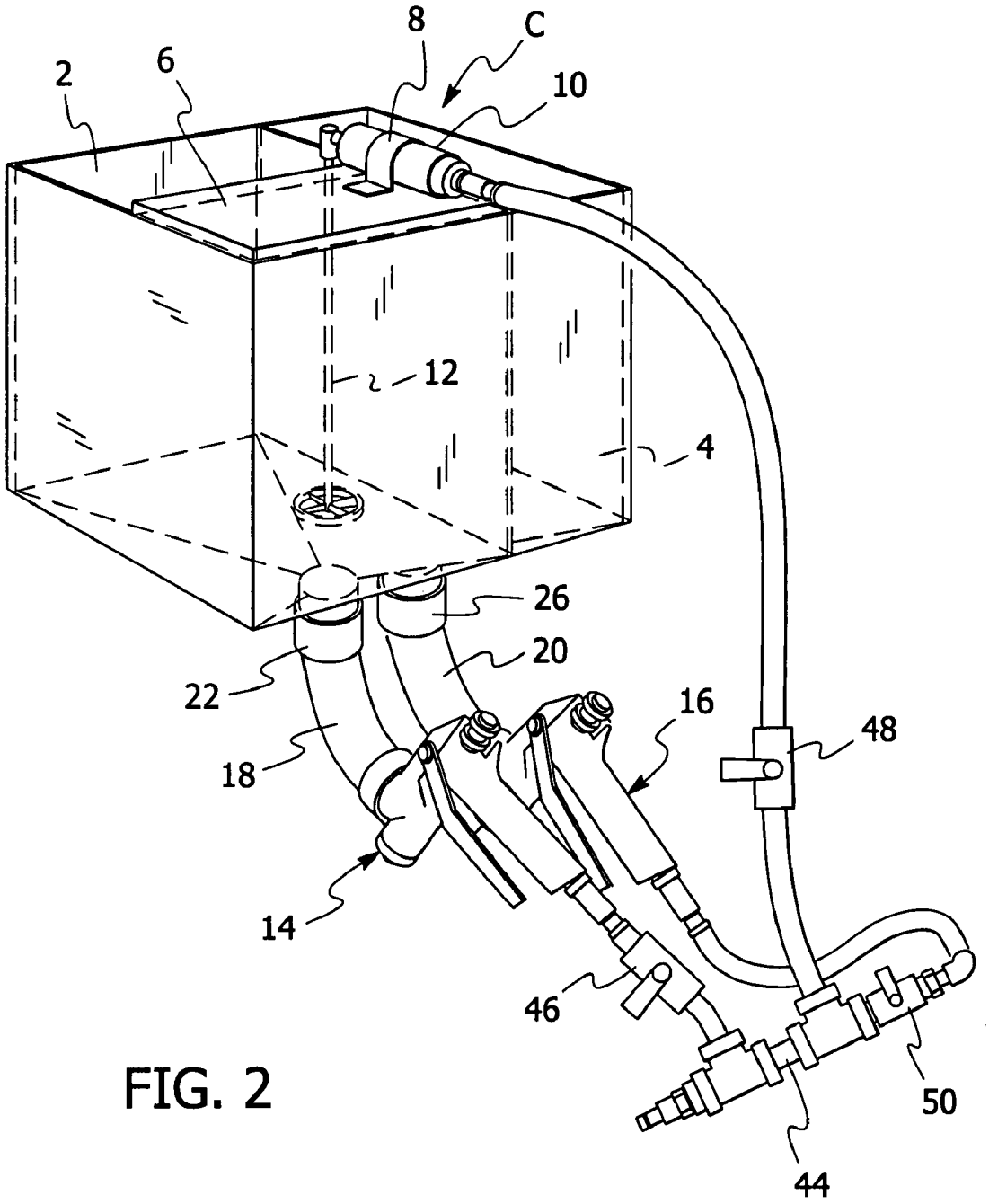
FIG. 2 is a perspective view of an applicator/dispenser formed in accordance with a preferred embodiment of the present invention.
Figure 3:
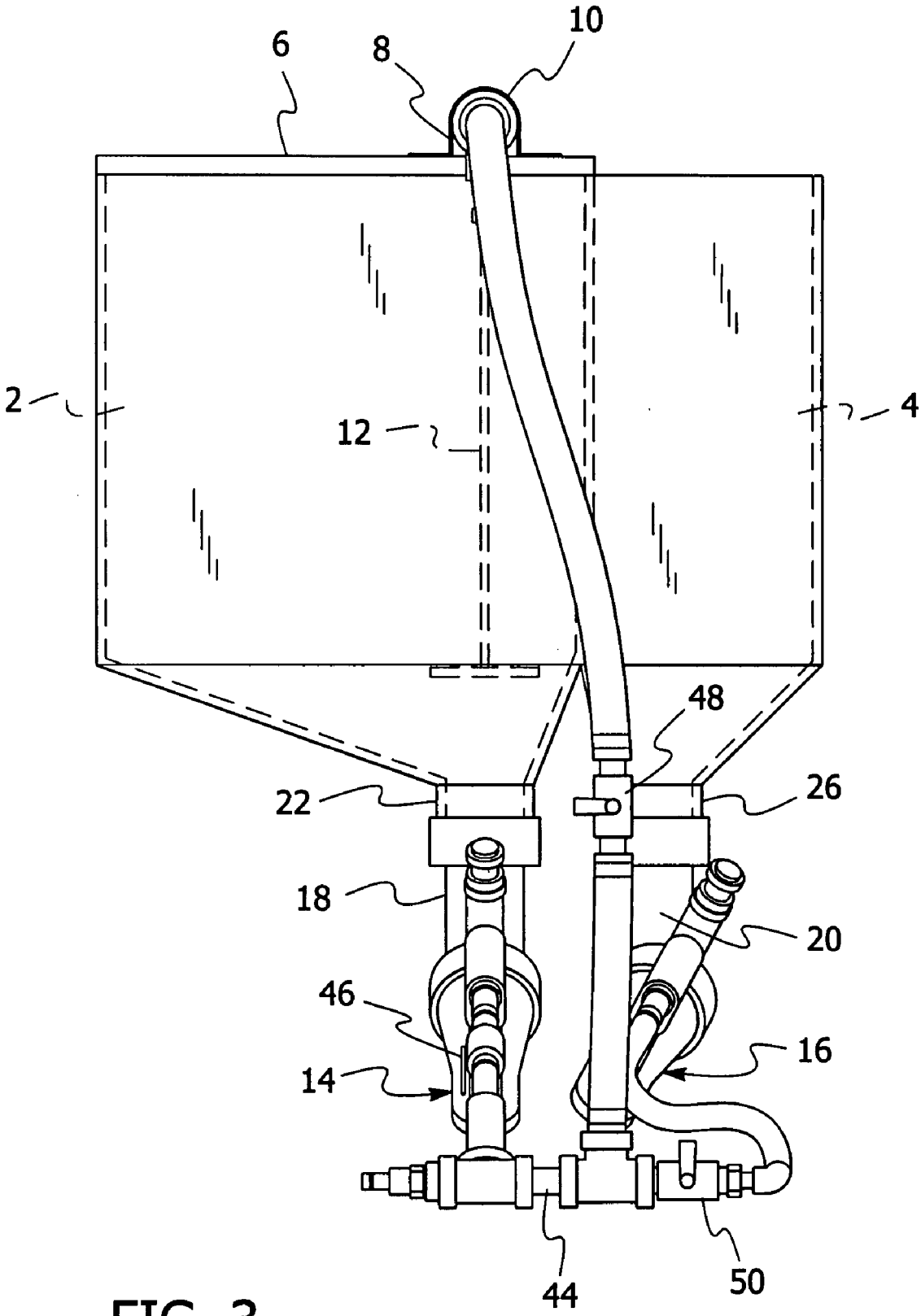
FIG. 3 is a front view of the applicator/dispenser depicted in FIG. 2.
Figure 4:
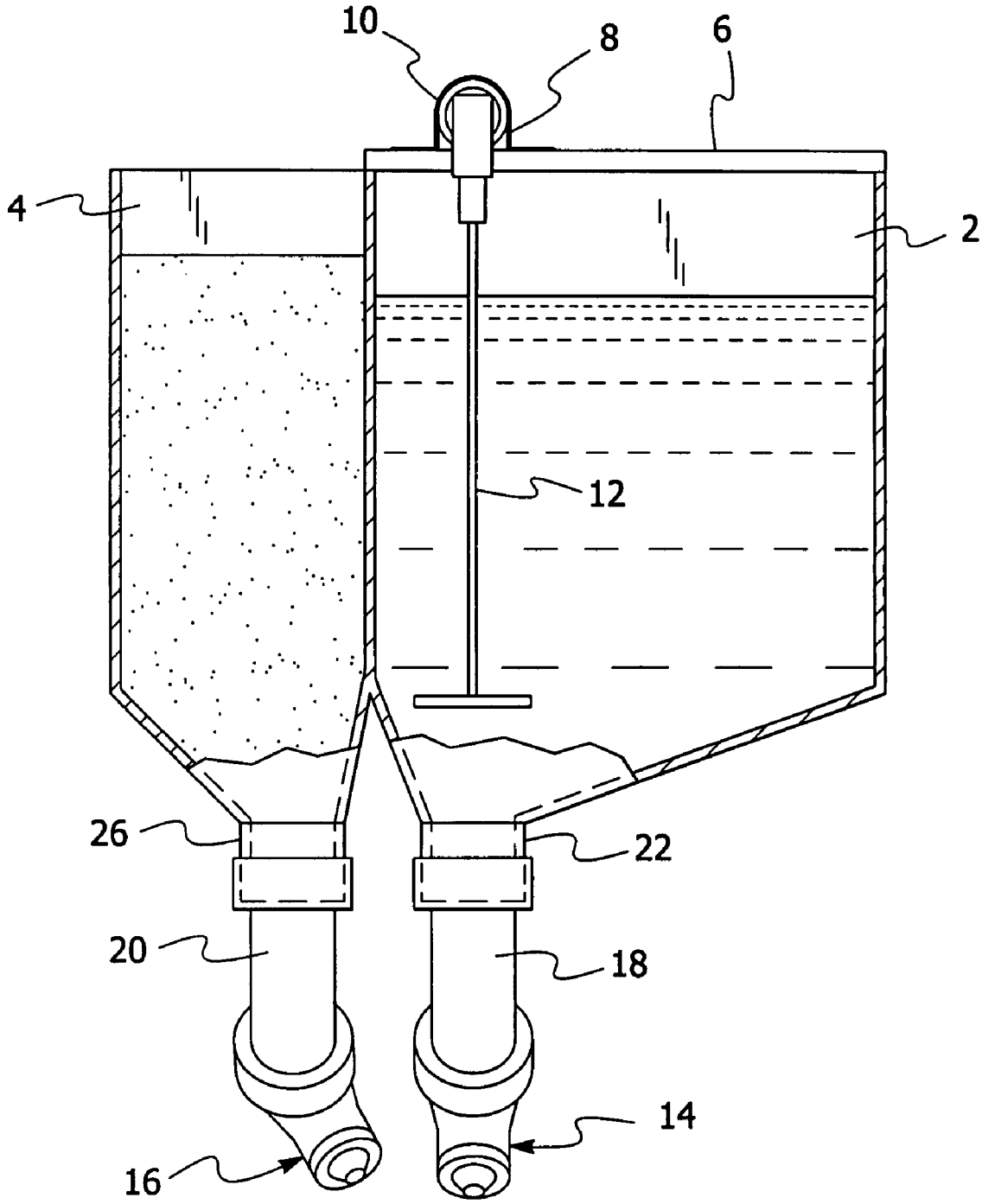
FIG. 4 is a fragmentary cross-sectional view of a portion of the applicator/dispenser formed in accordance with a preferred embodiment of the present invention.
Figure 5:
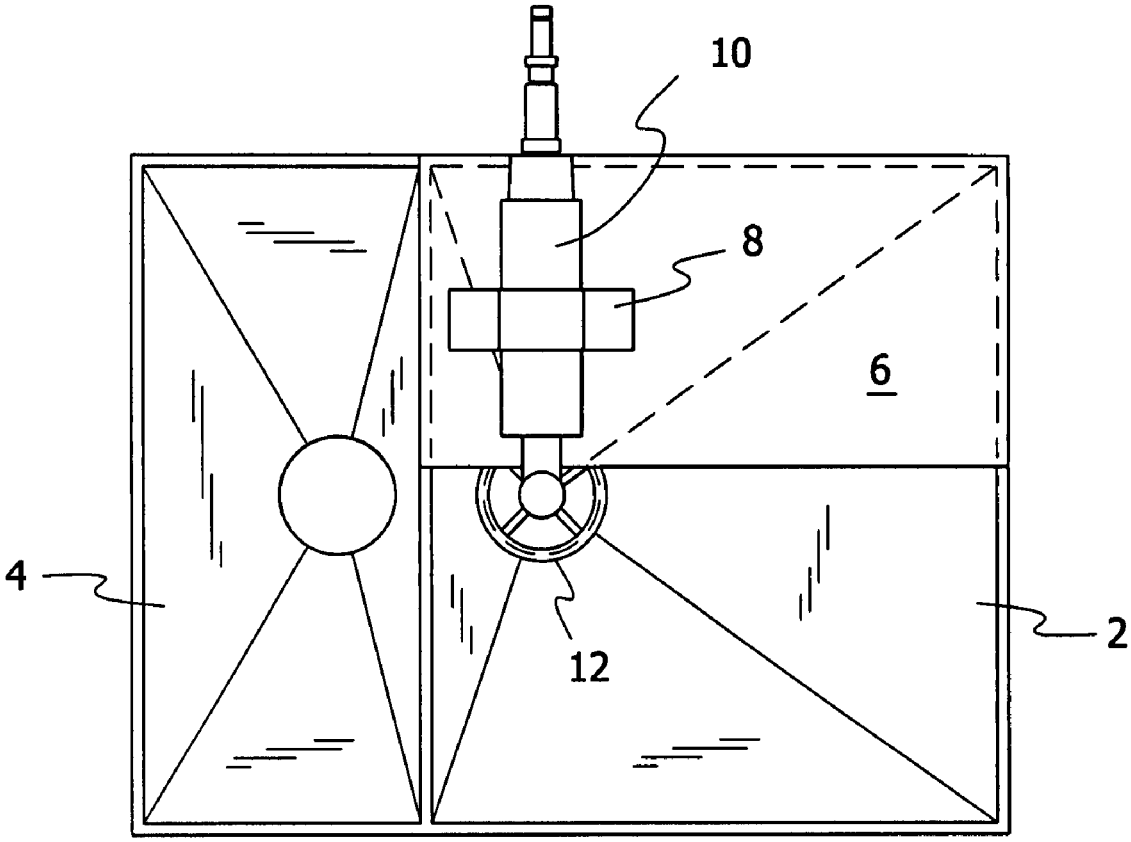
FIG. 5 is plan view of the hopper assembly of an applicator/dispenser formed in accordance with a preferred embodiment of the present invention.
Figure 6:
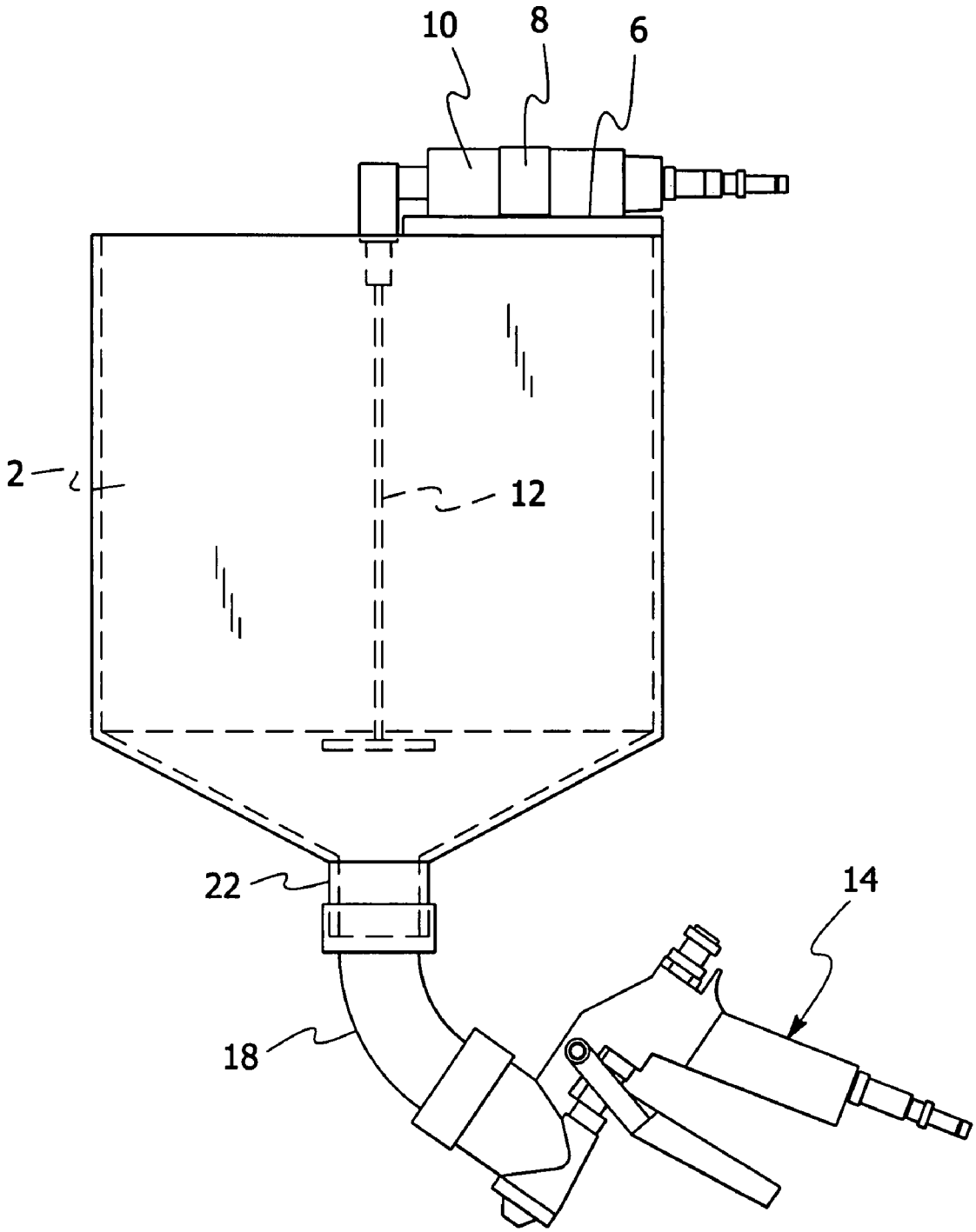
FIG. 6 is a side view of a portion of the applicator/dispenser formed in accordance with a preferred embodiment of the present invention.

As seen in FIGS. 2 and 4, guns 14 and 16 are positioned directly adjacent each other so that a single operator can simultaneously operate each gun while carrying the applicator A. Further, gun 16 may be tilted in the direction of gun 14 when applicator A is used to apply a non-skid coating to a surface so that the aggregate will be encapsulated by the coating material at or about the point impact of the surface to be coated. Where the coating does not require or desire that any material be encapsulated, gun 16 can be oriented in the same manner as gun 14. For example, where applicator A is used to provide a reflective coating on a surface, guns 14 and 16 would be oriented downwardly and neither gun would be titled toward the other.

A single fluid source (e.g., a single air compressor) maybe used to supply a pressurized fluid to guns 14 and 16 and motor 10. A manifold 44 and valves 46,48 and 50 may be used to vary the pressure of the fluid provided to guns 14 and 16 and motor 10. Valve 46 controls the flow of pressurized fluid (e.g., air) to gun 14. Valve 48 controls the flow of pressurized fluid (e.g., air) to motor 10. Valve 50 controls the flow of pressurized fluid (e.g., air) to motor 10. It should be noted that the applicator A may include pressure gauges to indicate the particular pressure of the fluid being supplied to guns 14 and 16 and motor 10. Alternatively, separate fluid sources (e.g., multiple air compressors) may be provided to accommodate any variance in pressure needed to operate guns 14 and 16 and motor 10.

Applicator A can be operated in different manners to apply different coatings. For example, where applicator A is used to apply a non-skid coating, compartment 2 is filled with a suitable coating material (e.g., E-KRETE®) manufactured by Polycon of Madison, Miss. while compartment 4 is filled with aggregate (e.g., sand). Valves 46, 48 and 50 are adjusted such that air is supplied to motor 10 and gun 16 at approximately 60 psi while air at approximately 80 psi is supplied to gun 14. The operator simultaneously pulls the triggers of guns 14 and 16 to simultaneously dispense the aggregate and coating materials from compartments 4 and 2, respectively. The orientation of the nozzles of guns 14 and 16 in the manner depicted in FIG. 4 causes the coating material to encapsulate the aggregate upon impact of the surface to be coated, i.e., the stream of sand and coating material merge at the point of impact with the surface to be coated. In this manner, the non-skid coating can be readily applied in a single step.

For other coatings it may not be necessary or desirable to encapsulate or completely embed one material in another material. For example, applicator A can be used to form a reflective coating on a surface. In this instance, gun 16 is reoriented such that it points straight down (i.e., not titled toward gun 14). Compartment 2 can contain the same coating material (e.g., E-KRETE®) while compartment 4 would contain glass beads or other reflective material. The coating material include a color pigment to provide a colored reflective surface (for example, red or yellow directional arrows on a roadway). In this instance, the operator would first engage only gun 14 to apply the coating material from compartment 2 onto the surface to be coated. After the coating is applied to the surface, the operator would engage only gun 16 to dispense the glass beads over the coating so that the glass beads are adhered to the surface by the coating while a portion thereof is still exposed to provide the necessary reflection when illuminated. As is readily apparent from the above discussion, applicator A can simultaneously dispense two materials or one material at a time. It will be readily appreciated that the applicator of the present invention is not limited to non-skid or reflective coatings. Rather, the present invention could be used to protective coatings, decorative coatings, etc.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

I claim:

1. An apparatus for applying a coating to a surface, said apparatus comprising:

(a) a hopper assembly having a first compartment and a second compartment operably associated with said first compartment, said first compartment being configured to receive and store an aggregate, said second compartment being configured to receive and store a coating substance, said hopper assembly being further configured such that the aggregate does not mix with the coating substance when the aggregate and the coating substance are stored in said first compartment and said second compartment, respectively; and, (b) means for simultaneously dispensing the aggregate and the coating substance from said first compartment and said second compartment so that at least a portion of the aggregate stored in said first compartment mixes with the coating substance after the aggregate and the coating substance are dispensed from said first compartment and said second compartment, respectively and, (c) wherein said means for simultaneously dispensing includes a first pressurized air gun operably associated with said first compartment and a second pressurized air gun operably associated with said second compartment.

2. An apparatus as set forth in claim 1, wherein:

(a) said first pressurized air gun is disposed adjacent said second pressurized air gun such that a single individual can operate both said first pressurized air gun and said second pressurized air gun.

3. An apparatus as set forth in claim 2, further including:

(a) an agitator operably associated with said second compartment for agitating the coating substance stored therein.

4. An apparatus as set forth in claim 3, further including:

(a) a pressurized air system, said pressurized air system providing pressurized air at a first pressure to both said agitator and said first pressurized air gun, said pressurized air system further providing pressurized air at a second pressure to said second pressurized air gun, the second pressure being higher than the first pressure.

5. An apparatus as set forth in claim 1, wherein:

(a) said hopper assembly is portable.

6. An apparatus for applying a coating to a surface, said apparatus comprising:

(a) a hopper assembly having a first compartment and a second compartment operably associated with said first compartment, said first compartment being configured to receive and store a first material, said second compartment being configured to receive and store a second material, said first material being different from said second material;

(b) a first applicator gun operably associated with said first compartment for dispensing said first material from said first compartment and onto a surface to be coated;

(c) a second applicator gun operably associated with said second compartment for dispensing said second material from said second compartment and onto a surface to be coated; and, (d) a support member for supporting said hopper assembly, said first applicator gun and said second applicator gun about an individual's body to allow the individual to carry said hopper assembly, said first applicator gun and said second applicator gun while material is being dispensed from said hopper assembly.

7. An apparatus as set forth in claim 6, wherein:

(a) said first applicator gun is disposed relative to said second applicator gun such that the aggregate mixes with the coating substance at a point of impact with a surface to be coated.

8. An apparatus as set forth in claim 6, wherein:

(a) said first applicator gun is disposed below said first compartment and said second applicator gun is disposed below said second compartment.

9. An apparatus as set forth in claim 6, wherein:

(a) said first applicator gun is operable to dispense sand from said first compartment.

10. An apparatus as set forth in claim 6, wherein:

(a) said second applicator gun is operable to dispense a cementitious mixture from said second compartment.

11. An apparatus as set forth in claim 6, wherein:

(a) said hopper assembly is formed from polyethylene.

12. An apparatus as set forth in claim 6, wherein:

(a) a first rubber hose connects said first compartment to said first applicator gun; and, (a) a second rubber hose connects said second compartment to said second applicator gun.

13. An apparatus for applying a coating to a surface, said apparatus comprising:

(a) a hopper assembly having a first compartment and a second compartment operably associated with said first compartment, said first compartment being configured to receive and store a first material, said second compartment being configured to receive and store a second material, the first material having at least one property different from the second material;

(b) a first dispenser operably associated with said first compartment for dispensing the first material from said first compartment and onto a surface to be coated; and, (c) a second dispenser operably associated with said second compartment for dispensing the second material from said second compartment and onto a surface to be coated, said second dispenser being disposed relative to said first dispenser such that the second material mixes with the first material upon contacting a surface to be coated, and (d) wherein, said first dispenser is a first pressurized air gun and said second dispenser is a second pressurized air gun.

14. An apparatus as set forth in claim l3, further including:

(a) a pressurized air system, said pressurized air system providing pressurized air at a first pressure to said first pressurized air gun, said pressurized air system further providing pressurized air at a second pressure to said second pressurized air gun, the second pressure being higher than the first pressure.

15. An apparatus for applying a coating to a surface, said apparatus comprising:

(a) a hopper assembly having a first compartment and a second compartment operably associated with said first compartment, said first compartment being configured to receive and store a first material, said second compartment being configured to receive and store a second material, said first material being different from said second material;

(b) a first applicator gun operably associated with said first compartment for dispensing said first material from said first compartment and onto a surface to be coated;

(c) a second applicator gun operably associated with said second compartment for dispensing said second material from said second compartment and onto a surface to be coated; and, (d) a pressurized air system for providing pressurized air to said first applicator gun and pressurized air to said second applicator gun wherein pressurized air directed to said first applicator gun is at a different air pressure than pressurized air directed to said second applicator gun.

16. An apparatus as set forth in claim 15, further including:

(a) an agitator operably associated with said second compartment for agitating the second material.

17. An apparatus as set forth in claim 16, wherein:

(a) the first material is an aggregate and the second material is a coating substance; and, (b) said pressurized air system supplies pressurized air to said agitator to drive said agitator, said pressurized air supplied to said agitator is at a pressure equal to the pressure of the pressurized air supplied to said first applicator gun.

18. An apparatus for applying a coating to a surface, said apparatus comprising:

(a) a hopper assembly having a first compartment and a second compartment operably associated with said first compartment, said first compartment being configured to receive and store a first material, said second compartment being configured to receive and store a second material, said hopper assembly being further configured such that the first material does not mix with the second material while the first material and the second material are stored in said first compartment and said second compartment, respectively; and, (b) a dispenser system for dispensing the first material and the second material from said first compartment and said second compartment, respectively, said dispenser system being configured to simultaneously dispense the first material and the second material from said first compartment and said second compartment, said dispenser system further being configured to dispense one of the first material and the second material from a corresponding compartment without dispensing the other of the first material and the second material from a corresponding compartment, and (c) a harness operably connected to said hopper assembly to allow an individual to carry said hopper assembly while material is being dispensed therefrom.

19. An apparatus as set forth in claim 18, wherein:

(a) said first compartment contains a first reflective material and said second compartment contains a binding substance to bind the reflective material to the surface to be coated.

20. An apparatus as set forth in claim 18, wherein:

(a) said first compartment contains an aggregate and the second compartment contains a cementitious mixture.

* * * * *